United States Patent [19]

Thomas et al.

[11] Patent Number: 4,880,336

[45] Date of Patent: Nov. 14, 1989

[54] SUSPENSION DEVICE FOR THE SUPPORT LEGS OF A JACK-UP OIL PLATFORM

[75] Inventors: Pierre-Armand Thomas, Puteaux; Raphael Grundman, St. Arnould, both of France

[73] Assignees: Technip Geoproduction, Paris; Engrenages et Reducteurs Citroen-Messian-Durand, Velizy Villacoublay, both of France

[21] Appl. No.: 125,981

[22] Filed: Nov. 27, 1987

[30] Foreign Application Priority Data

Nov. 26, 1986 [FR] France ..... 86 16504

[51] Int. Cl.[4] ..... E02D 21/00

[52] U.S. Cl. ..... 405/198; 267/141.1; 267/276; 403/227; 405/195

[58] Field of Search ..... 405/195, 196, 198; 403/227; 267/141.1, 276, 254, 281, 279, 282

[56] References Cited

U.S. PATENT DOCUMENTS

| | | | |
|---|---|---|---|
| 2,855,212 | 10/1958 | Houser | 403/227 X |
| 3,075,786 | 1/1963 | Freers et al. | 403/227 X |
| 3,406,523 | 10/1968 | Baker et al. . | |
| 4,269,543 | 5/1981 | Goldman et al. | 405/198 |
| 4,482,272 | 11/1984 | Colin | 405/198 |
| 4,521,134 | 6/1985 | Schoonmade | 405/198 |
| 4,574,650 | 3/1986 | Duyand et al. | 405/198 X |
| 4,627,768 | 12/1986 | Thomas et al. | 405/196 X |
| 4,759,662 | 7/1988 | Peppel | 405/195 |

FOREIGN PATENT DOCUMENTS

| | | |
|---|---|---|
| 2436099 | 4/1980 | France . |
| 8300351 | 2/1983 | World Int. Prop. O. . |

*Primary Examiner*—Dennis L. Taylor

*Attorney, Agent, or Firm*—Wenderoth, Lind & Ponack

[57] ABSTRACT

The suspension device for the support legs of a jack-up oil platform having a hull movable along the legs includes a driving mechanism having a plurality of output gear pinions cooperating with racks mounted along at least a part of the legs. Each of the output gear pinions is drivable by an electric motor associated with a speed reducer which is pivotally mounted on a structure which is connected to the hull and has at least one bearing which allows a given angular movement of the speed reducer and each corresponding output gear pinion. Each speed reducer cooperates with an energy absorbing mechanism including at least one torsionally elastically yieldable support element connected to a corresponding speed reducer and affording a progressive absorption of shock particularly at the moment when the legs contact the sea floor.

16 Claims, 8 Drawing Sheets

SUSPENSION DEVICE FOR THE SUPPORT LEGS OF A JACK-UP OIL PLATFORM

BACKGROUND OF THE INVENTION

The present invention relates to a suspension device for the support legs of platforms for facilitating oil drilling or oil production at sea, and more particularly relates to jack-up platforms.

Platforms of this type generally comprise legs which bear on the sea floor and a hull which is mounted on the legs so as to be movable along said legs.

The entire platform assumes a floating state at the drilling or production site and the legs are lowered until they contact the sea floor. Then the hull is raised above the level of the sea, by bearing against the legs, to an elevation at which the hull is out of reach of the highest waves.

The hull is therefore movable along the legs of the platform by raising mechanisms connected to said hull and including output gear pinions whose bearings are connected to the hull and which cooperate with racks mounted on at least a part of the legs. These gear pinions are driven by a plurality of electric motors operatively associated with speed reducers having a very high speed reducing ratio.

At the moment that contact occurs between a leg and the bottom of the sea, at the end of the descent, the impact may be very violent in view of the movement of the hull under the effect of the swell. These shocks are transmitted to the raising mechanisms and this subjects the multiple gears of the speed reducers to a very high stress.

In order to ensure the reliable operation of the gears of the speed reducers at the moment of contact between the legs and the bottom of the sea, it is therefore necessary to considerably over-dimension them or to await favorable weather conditions which increase the costs associated with the installation.

SUMMARY OF THE INVENTION

An object of the invention is therefore to overcome the aforementioned drawbacks of conventional devices by providing a suspension device for jack-up oil platform legs which, while having a relatively simple structure, permits a decrease in the stresses due to the shocks in the structure, and above all in the gear pinions of the speed reducers, allows the laying of the platform during relatively severe conditions, and therefore over a wider range of meteorological conditions, and which does not overly contribute to the cost of the installation.

The invention provides a suspension device for support legs of a jack-up oil platform comprising a hull mounted on the legs and movable therealong by driving mechanisms including a plurality of output gear pinions cooperating with racks mounted on at least a part of the legs. Each of said output pinions is drivable by an electric motor associated with a speed reducer, is pivotally supported by structure connected to the hull and defining at least one bearing allowing angular movement of said speed reducer and each corresponding output gear pinion, and cooperates with an energy absorbing mechanism comprising at least one torsionally elastically yieldable support element connected to said corresponding speed reducer and ensuring a progressive absorption of the shock, particularly at the moment of contact between the legs and the sea floor.

BRIEF DESCRIPTION OF THE DRAWINGS

A better understanding of the invention will be had from the following description which is given solely by way of example with reference to the accompanying drawings, in which.

DETAILED DESCRIPTION OF THE PREFERRED EMBODIMENTS

Figure 1:
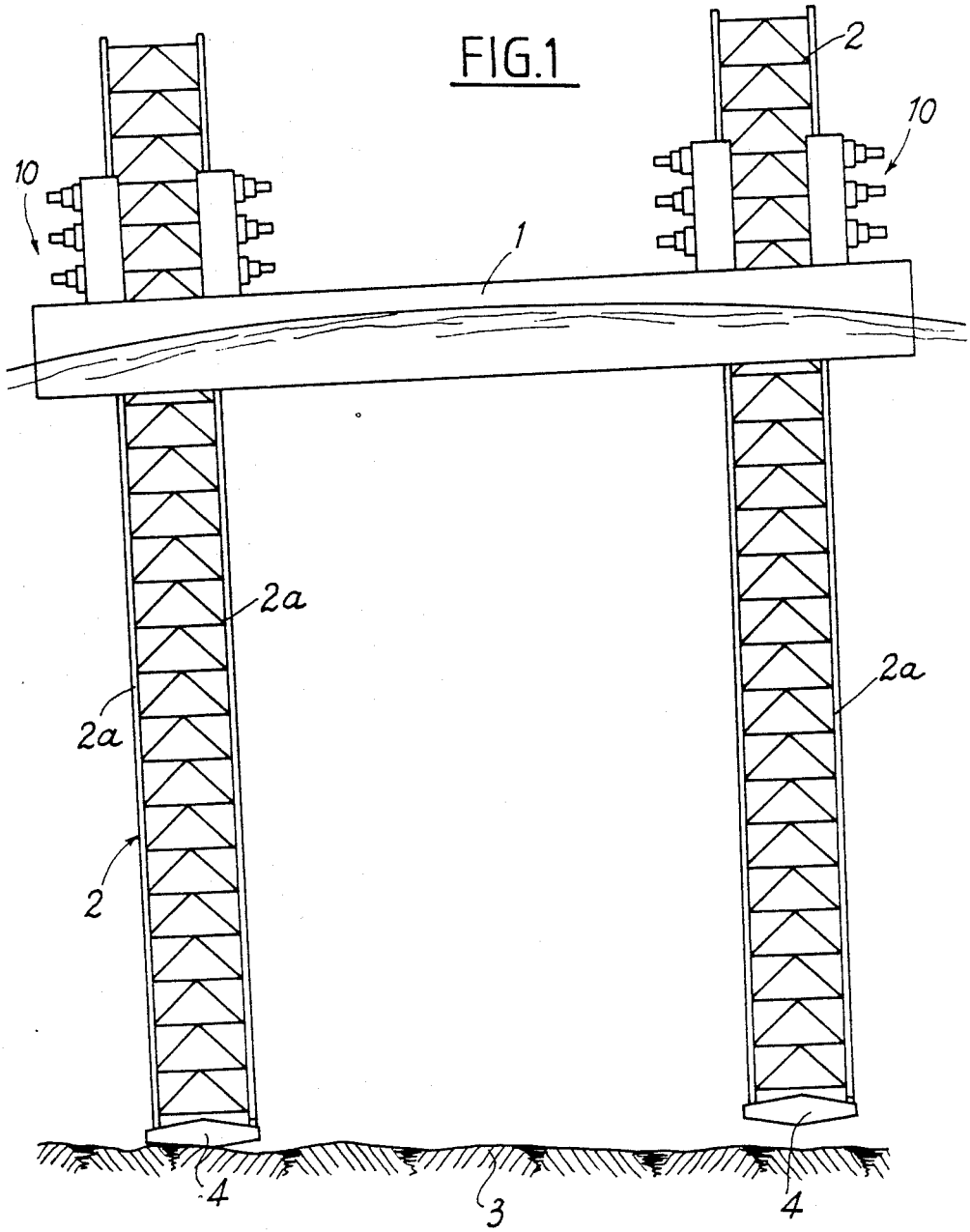
FIG. 1 is a diagrammatic elevational view of a jack-up oil platform during the lowering of the legs.

FIG. 1 shows, diagrammatically, a jack-up or self-lifting oil platform comprising a hull 1 movably mounted on vertical legs 2 adapted to rest on the sea floor 3 when the platform is in the drilling or production position.

Each of the vertical legs 2 has, in the presently-described embodiment, a triangular sectional shape and includes three pillars **2*a* interconnected by a lattice structure of metal girders. It terminates at its lower part in a base 4** which, in the presently-described embodiment, has a hexagonal shape.

The platform is equipped, in the region of each leg 2, with a system 10 for shifting and suspending the hull 1 relative to said legs. This shifting system 10 permits the lowering of the legs 2 down to a position in which they are in contact with the sea floor, and then, by bearing against the legs, permits the raising of the hull 1 above the sea to an elevation at which the hull is out of reach of the highest waves.

Figure 2:
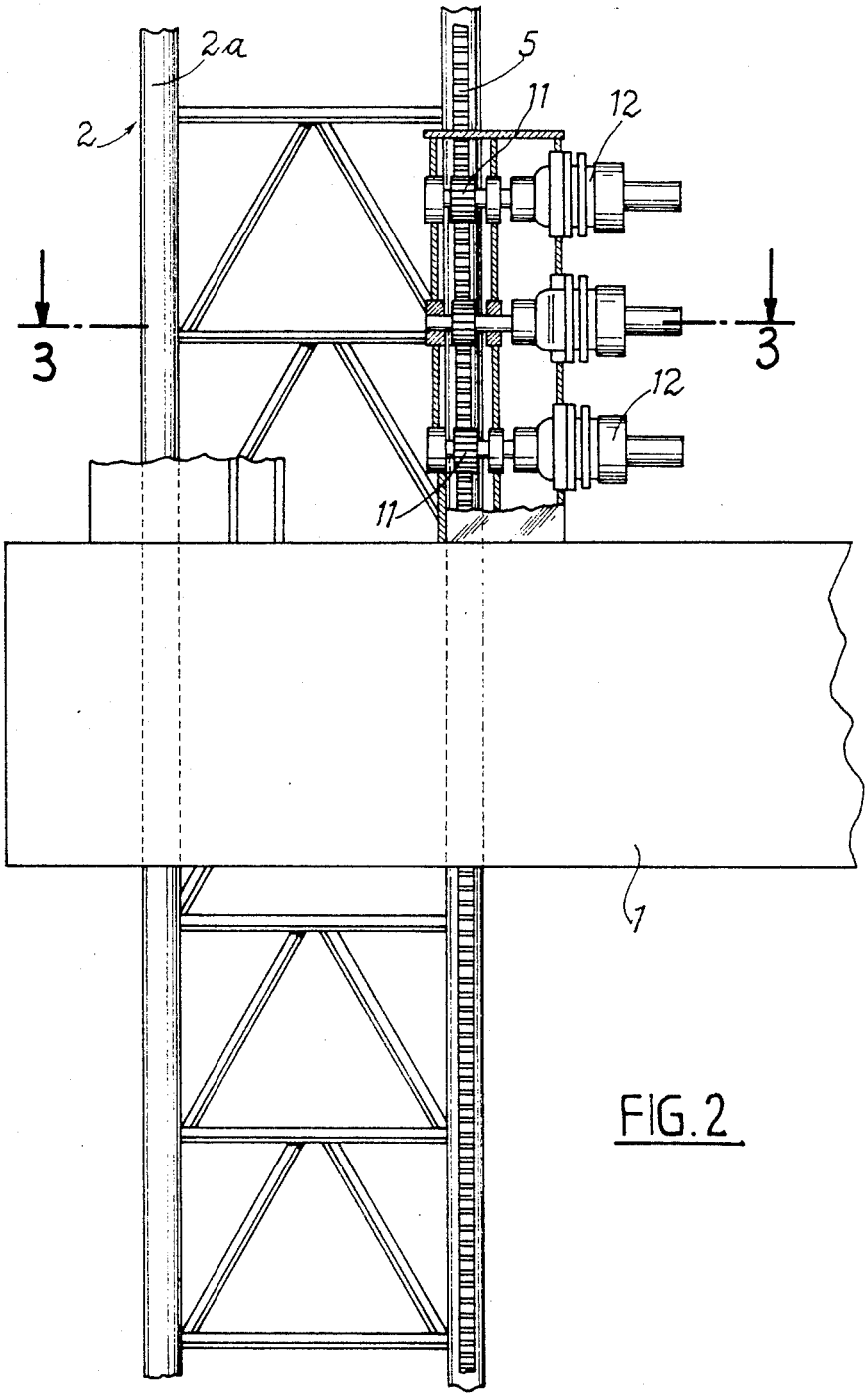
FIG. 2 is a diagrammatic view, on an enlarged scale, of a section of one of the legs of the platform showing a leg shifting mechanism.
Figure 3:
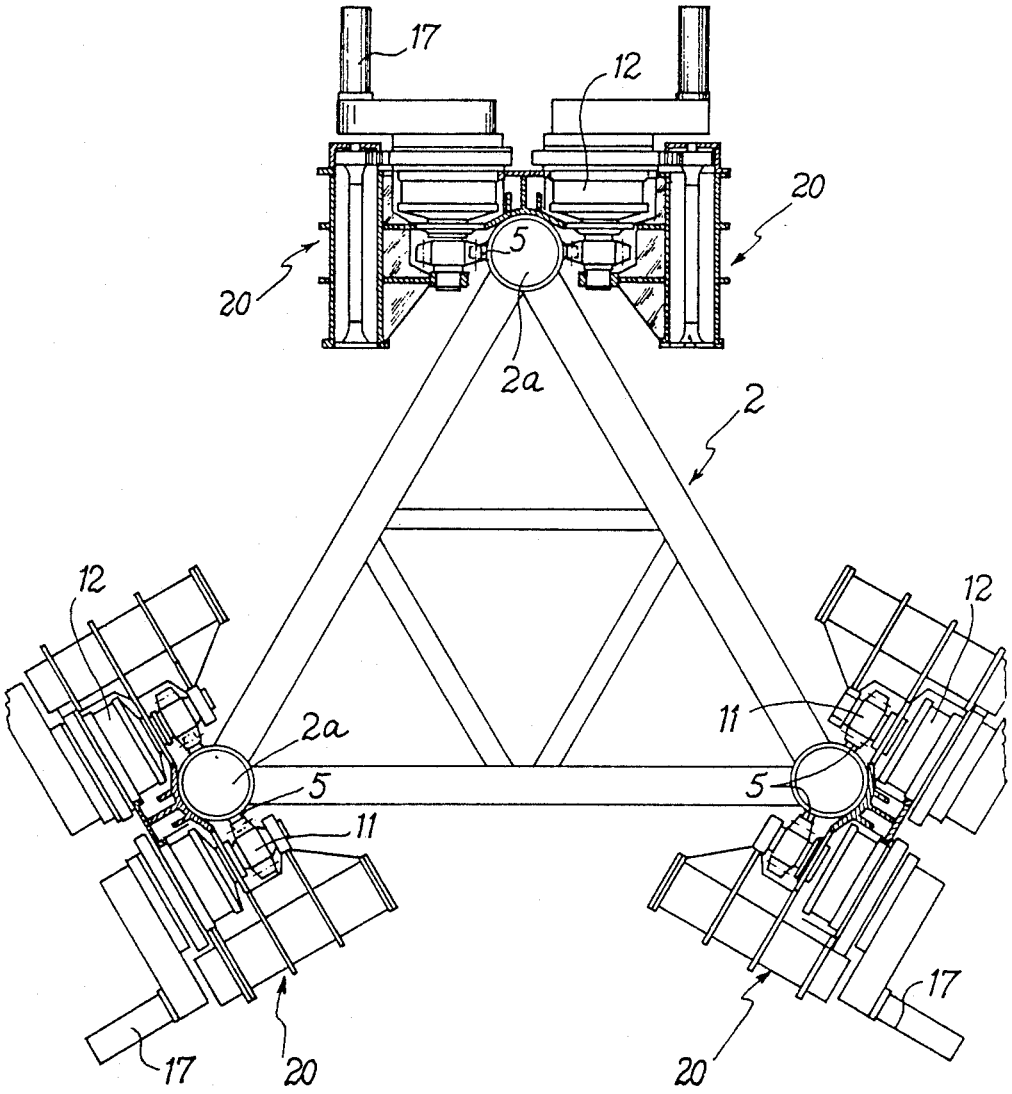
FIG. 3 is a sectional view taken along line 3-3 of Fig. 2.

For this purpose, as shown in FIGS. 2 and 3, the pillars **2*a* of the legs 2 are provided with diametrically opposed racks 5 disposed along a portion of the legs 2 and which are operatively associated with output gear pinions 11 of motor drive mechanisms 12 mounted on the hull 1. For example, six output gear pinions may be provided for each pillar 2*a* each being equipped with a motor drive mechanism 12**.

Figure 4:
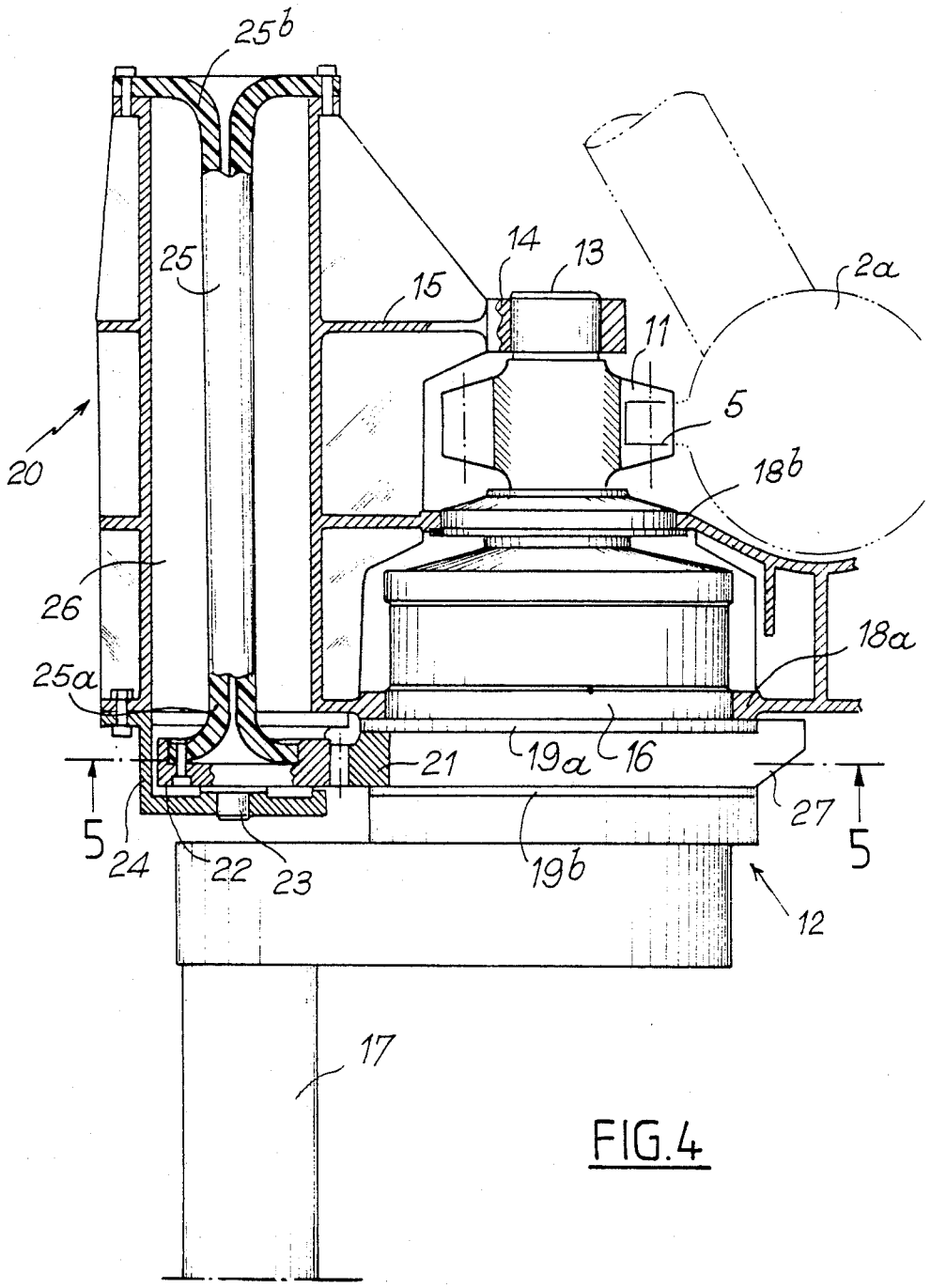
FIG. 4 is an elevational view of a first embodiment of the suspension device according to the invention.

With reference now to FIG. 4, a motor drive mechanism 12 will now be described in more detail.

FIG. 4 shows part of the pillar **2*a* of a leg provided with the rack 5 which cooperates with the output gear pinion 11. This pinion 11 is mounted on a shaft 13 which is supported at one of its ends by a bearing 14 of a structure 15 mounted on the hull. The shaft 13 is rotated by a speed reducer 16 which is driven by an electric motor 17**.

The speed reducer 16 is pivotally mounted on the structure 15 which carries it by means of bearings **18*a* and 18*b*, whereby a certain angular movement of said speed reducer, and therefore of the corresponding output pinion 11** is possible during the descent and the laying of the leg, as will be seen hereinafter.

Further, the speed reducer 16 is connected to a mechanism 20 for absorbing energy, in particular at the moment contact occurs between the leg and the sea floor.

For this purpose, the speed reducer 16 includes two external flanges 19*a* and 19*b* between which is fixed a toothed sector 21 which cooperates with a pinion 22 (FIG. 5) mounted on a shaft 23 which is rotatively supported by a housing 24 fixed to the structure 15. Further, the pinion 22 is mounted on the end 25*a* of an elastically yieldable support element which, in the embodiment shown in FIG. 4, is constituted by a torsion bar 25 disposed in a cavity 26 defined inside the structure 15. The other end 25*b* of the torsion bar 25 is immobilized by the structure 15.

The torsion bar 25 may be made from steel or a composite material having a high degree of strength. It may also be a tube of composite material obtained by winding and composed of glass threads and epoxide resin.

Figure 5:
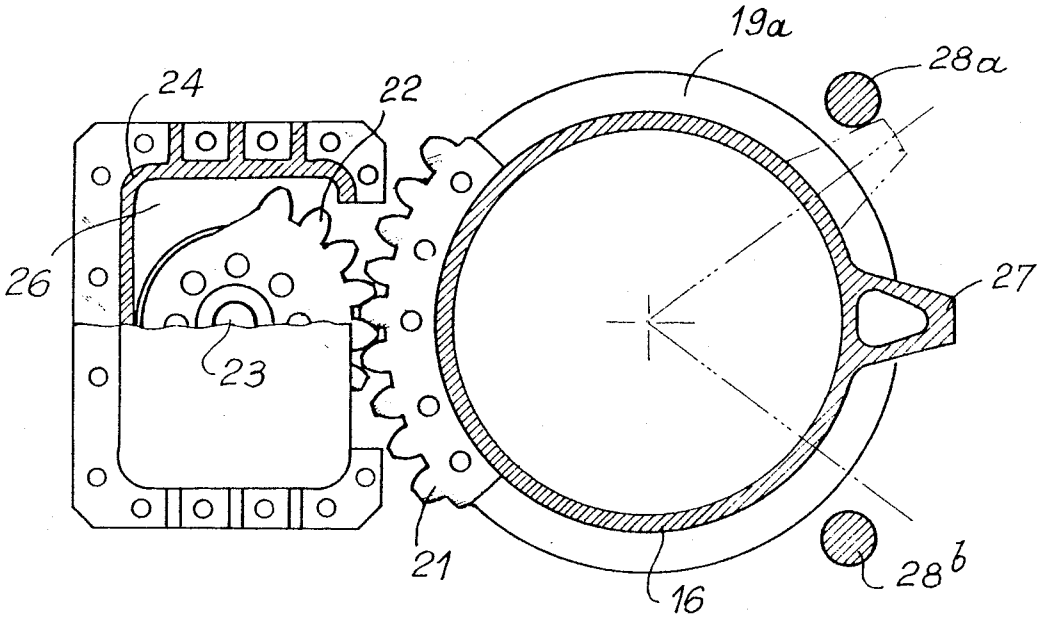
FIG. 5 is a sectional view taken along line 5-5 of Fig. 4.

The speed reducer 16 also includes, on the side opposite to the toothed sector 21, a lug 27 for limiting the angular movement of the speed reducer between two end-of-travel stops 28*a* and 28*b* (FIG. 5).

Each system for shifting and suspending the hull 1 of the oil platform is therefore arranged in this way.

The entire platform is therefore in a floating state at the drilling or production site and the legs 2 are lowered until the legs contact the sea floor. For this purpose, the electric motors 17 therefore drive, through the speed reducers 16, the output gear pinions 11 which mesh with the racks 5. During the descent of the legs 2, the electric motors 17 act as brakes.

When the leg 2 comes into contact with the sea floor at the end of the descent, the impact may be very violent bearing in mind the movements of the hull under the effect of the swell. The shock is therefore transferred to the output gear pinions 11 by the rack 5 which causes the speed reducers 16 to rotate in the bearings 18*a* and 18*b*. Each speed reducer 16 by rotating drives the toothed sector 21 which in turn drives the gear pinion 22. The reaction torque is therefore transmitted to the various torsion bars 25 which are deformed and act as suspension elements of the leg 2 on the hull 1.

This suspension device absorbs the shock at the moment contact occurs between the leg and the sea floor under a progressive absorbtion of energy during an interval determined by the stops 28*a* and 28*b* between which the lug 27 of the speed reducer 16 of each motor-driven mechanism travels. This travel allows, due to the articulated mounting of the speed reducer 16 on the structure, a predetermined rotation of the output gear pinions 11 at the moment of impact and thus allows the racks 5 and therefore the legs 2 to oscillate and to be stabilized by progressively transmitting the load of the platform to the sea floor.

Figure 6:
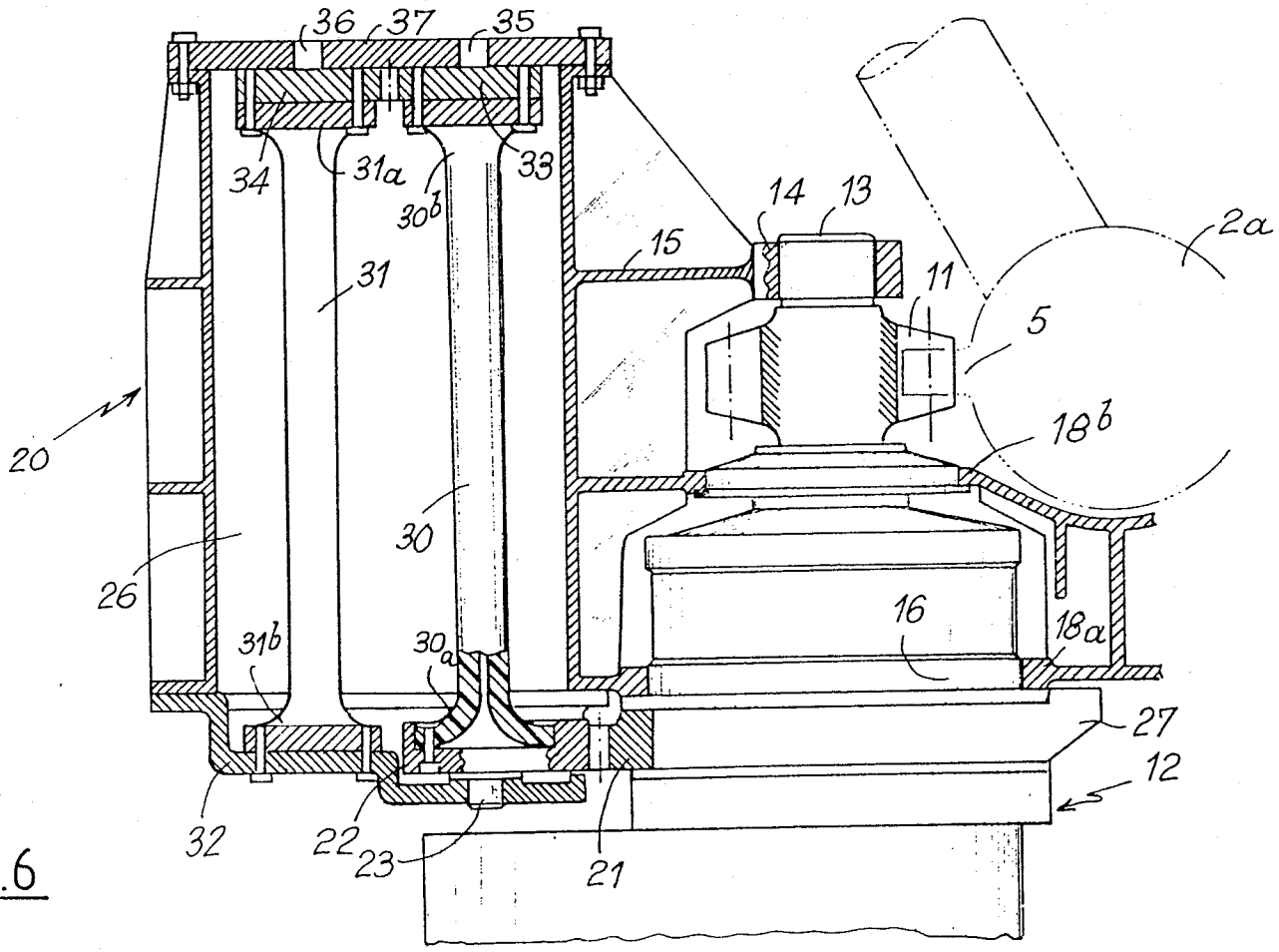
FIG. 6 is an elevational view of another embodiment of the suspension device according to the invention.

In the embodiment shown in FIG. 6, the elastically yieldable support element of the energy absorbing mechanism 20 is constituted by two torsion bars 30 and 31 connected in series and disposed in the cavity 26 of the structure 15. The toothed sector 21 of the speed reducer 16 is engaged with the gear pinion 22 mounted on the shaft 23 which is rotatively supported by a housing 32 fixed to the structure 15. The gear pinion 22 is mounted on the end 30*a* of the first torsion bar 30. The other end 30*b* of this first torsion bar 30 is connected to a gear pinion 33 which mesh with a gear pinion 34 mounted on the end 31*a* of the second torsion bar 31. The gear pinions 33 and 34 are each mounted on a respective shaft 35 and 36 rotatively supported by a rear housing 37 fixed to the structure 15. The end 31*b* of the torsion bar 31 is immobilized by the front housing 32.

The reaction torque applied to the speed reducer 16 is transmitted through the toothed sector 21 and the gear pinion 22 to the first torsion bar 30 which is deformed. By deforming, the first torsion bar 30 drives the gear pinions 33 and 34 and this causes the deformation of the second torsion bar 31, one of the ends of which is immobilized by the structure. The torque is therefore taken up by the two torsion bars 30 and 31 which permits an absorbtion of the shock at the moment the leg contacts the sea floor.

With this arrangement of two torsion bars, the overall size is relatively small and there is a great degree of flexibility in providing shock absorbtion. If required, additional torsion bars connected in series may be provided.

Figure 7:
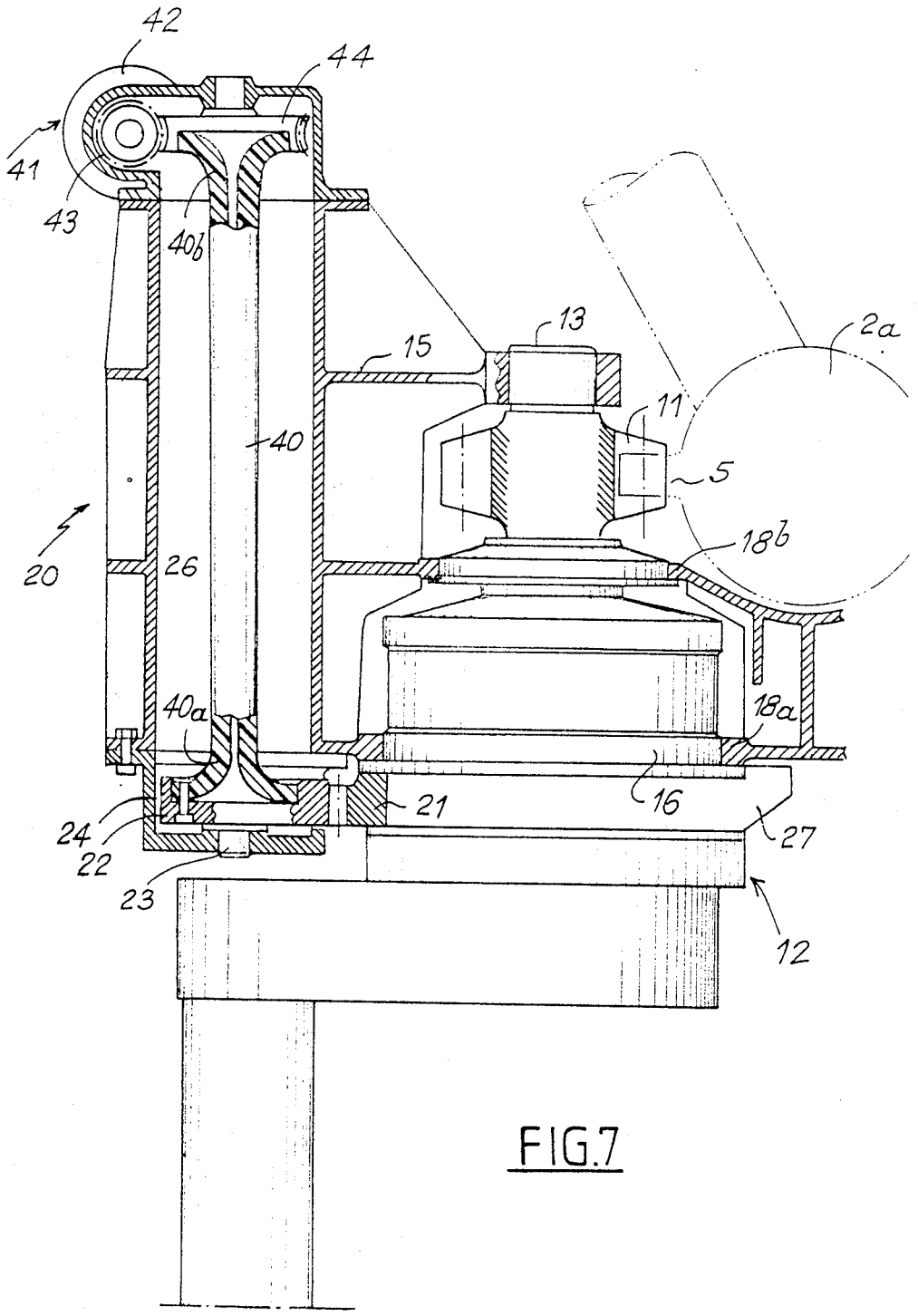
FIG. 7 is an elevational view of another embodiment, of the suspension device according to the invention.

In the embodiment shown in FIG. 7, the end 40*a* of the torsion bar 40 has, as before, a gear pinion 22 which cooperates with the toothed sector 21 fixed to the speed reducer 16. On the other hand, the other end 40*b* of the torsion bar 40 is provided with a pre-setting system 41 for presetting the torsion of said bar. This pre-setting system 41 comprises a motor-speed reducer unit 42 drivingly engaged with a gear wheel 43 which meshes with a toothed ring 44 fixed to the end 40*b* of the torsion bar. This pre-setting system may be advantageously constituted by a worm and worm wheel assembly.

The pre-setting system permits, by means of the gear wheel 43 and the ring gear 44, a pre-deformation of the torsion bar 40 and a modification of the position of the neutral point of the lug 27 limiting the angular movement of the speed reducer between the two end-of-travel stops 28*a* and 28*b* (FIG. 5).

Figure 8:
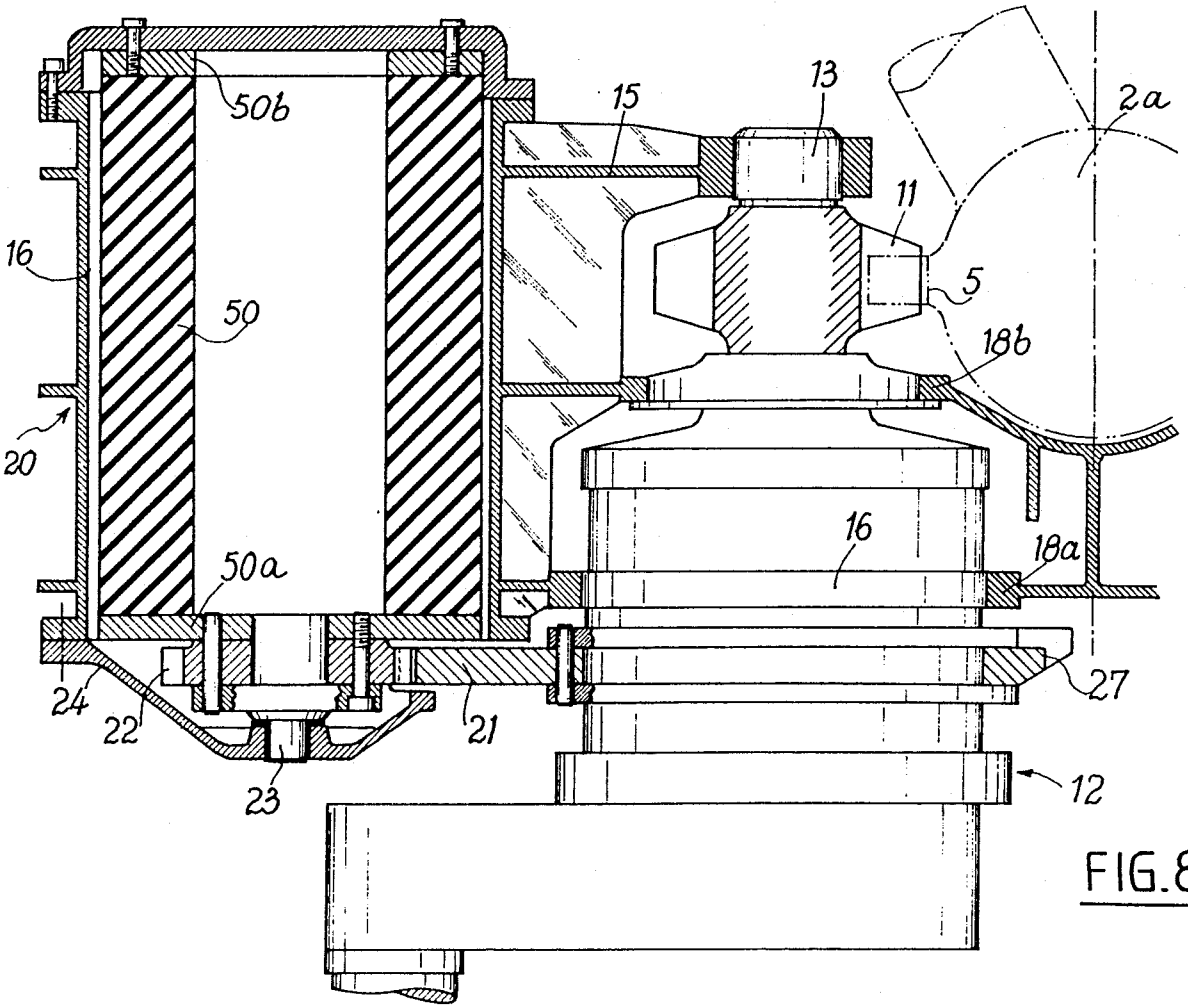
FIG. 8 is an elevational view of a still further embodiment of the suspension device according to the invention.

The energy absorbing mechanism 20 shown in FIG. 8 comprises a torsion bar 50 formed by a tubular sleeve composed of an elastomer or a like elastic material in which there may be incorporated rigid washers. As in the preceding embodiments, the end 50*a* of the torsion bar 50 is mounted on the gear pinion 22 driven by the toothed sector 21 and the opposite end 50*b* is immobilized by the structure 15.

Further, this torsion bar may also be formed by a solid cylinder comprising an elastomer or a like elastic material, or of a laminated material formed by a juxtaposition of elastomeric or rigid washers.

The end 50*b* of the torsion bar 50 may also be associated with a torsion pre-setting system.

It can be seen that the various described embodiments permit a reduction in the stresses due to shocks in the structure, and above all in the gearing of the speed reducers, and also a control of the balancing of the loads on all of the output gear pinions of said speed reducers.

Moreover, the suspension device according to the invention permits an equalization of the torques between all of the speed reducers of the system for shifting the legs relative to the hull, and thus affords the possibility of the laying of the platform under very severe sea conditions, and therefore within a wider meteorological range which considerably reduces the costs of installation.

Furthermore, this device also affords the possibility of measuring the load applied to the output gear pinions of the speed reducers by disposing, for example, a measuring element on the end of the torsion bar opposed to the driving gear pinion and measuring the angle of rotation of the rotating end of the torsion bar, said angle being proportional to this load.

What is claimed is:

1. In a jack-up oil platform having a hull, and legs mounted to said hull for supporting the hull on the sea floor, said legs and said hull movable relative to one another, a suspension device connected between said hull and said legs for moving said legs and said hull relative to one another, said device comprising:

a driving mechanism including respective racks extending along at least a portion of each of said legs, at least one output pinion meshing with each of said racks, an electric motor operatively connected to each said output pinion for rotating each said output pinion, and a respective speed reducer connected to and coupling each said electric motor and a respective said output pinion;

a structural support supporting said driving mechanism on said hull, said structural support including at least one bearing pivotally supporting each said speed reducer so as to allow said speed reducer to pivot relative to said structural support when shock is imparted thereto through the output pinion connected thereto; and energy absorbing means connected to each said speed reducer for absorbing shock imparted to said driving mechanism through each said output pinion thereof, said energy absorbing means comprising respective support means associated with each said speed reducer and having an axis about which the support means is torsionally elastically yieldable, and connecting means connected between each said support means and the speed reducer associated therewith for transmitting pivotal movement of said speed reducer into torsion about said axis of said support means, each said support means secured in the device so as to elastically deflect about the axis thereof when said pivotal movement is transmitted thereto by said connecting means.

2. A suspension device in a jack-up oil platform as claimed in claim 1, wherein each said support means has a first end fixed to said structural support and a second end, and said connecting means includes a respective toothed sector fixed to each said speed reducer, and a gear pinion mounted on the second end of said support means and meshing with a respective said toothed sector.

3. A suspension device in a jack-up oil platform as claimed in claim 2, wherein each said speed reducer includes a lug secured thereto so as to pivot therewith, and said device further comprises a respective pair of end-of-travel stops fixed therein and engageable with a respective said lug for limiting the pivotal movement of said speed reducer on which the lug is secured to a predetermined range of angular movement.

4. A suspension device in a jack-up oil platform as claimed in claim 2, wherein each said support means comprises a plurality of torsion bars connected to one another, each of said torsion bars having an axis about which the bar is torsionally elastically yieldable.

5. A suspension device in a jack-up oil platform as claimed in claim 2, wherein each said support means includes at least one torsion bar that is cylindrical and comprises elastic material.

6. A suspension device in a jack-up oil platform as claimed in claim 2, wherein each said support means comprises at least one torsion bar that is tubular and comprises elastic material.

7. A suspension device in a jack-up oil platform as claimed in claim 2, wherein each said support means includes at least one torsion bar comprising a laminate of juxtaposed elastomeric and steel washers.

8. A suspension device in a jack-up oil platform as claimed in claim 2, wherein each said support means includes at least one torsion bar that is tubular and comprises a composite material.

9. A suspension device in a jack-up oil platform as claimed in claim 2, wherein the device further includes an adjustable torsion pre-setting means connected to each said support means for pre-loading each said support means with a desired amount of torque.

10. A suspension device in a jack-up oil platform as claimed in claim 2, wherein said device further includes measuring means associated with each said support means for measuring the difference between the degrees to which the support means torsionally yields at said ends thereof.

11. A suspension device in a jack-up oil platform as claimed in claim 4, wherein each of said torsion bars is cylindrical and comprises elastic material.

12. A suspension device in a jack-up oil platform as claimed in claim 4, wherein each of said torsion bars is tubular and comprises elastic material.

13. A suspension device in a jack-up oil platform as claimed in claim 4, wherein each of said torsion bars is a laminate of juxtaposed elastomeric and steel washers.

14. A suspension device in a jack-up oil platform as claimed in claim 4, wherein each of said torsion bars is cylindrical and comprises a composite material.

15. A suspension device in a jack-up oil platform as claimed in claim 4, wherein each of said torsion bars is cylindrical, and said device comprises an adjustable torsion pre-setting means connected to each of said torsion bars for pre-loading said torsion bars with torque.

16. A suspension device in a jack-up oil platform as claimed in claim 4, wherein each of said torsion bars is cylindrical, and said device further includes measuring means associated with each said support means for measuring the difference between the degrees to which the support means torsionally yields at said ends thereof.

* * * * *